United States Patent [19]

Lundberg

[11] 4,152,909

[45] May 8, 1979

[54] LOCK

[75] Inventor: George A. Lundberg, Kinnelon, N.J.

[73] Assignee: E. J. Brooks Company, Newark, N.J.

[21] Appl. No.: 803,796

[22] Filed: Jun. 6, 1977

[51] Int. Cl.[2] ..... E05B 67/36

[52] U.S. Cl. ..... 70/34; 70/409

[58] Field of Search ..... 70/32, 33, 34, 386, 70/409, 407, 404, 402

[56] References Cited

U.S. PATENT DOCUMENTS

| | | | |
|---|---|---|---|
| 1,744,984 | 1/1930 | Page | 70/34 |
| 1,805,779 | 5/1931 | Metz | 70/34 |
| 1,978,781 | 10/1934 | Berger | 70/409 |
| 1,994,095 | 3/1935 | Caldwell | 70/404 |
| 3,914,965 | 10/1975 | Paxton | 70/34 |

FOREIGN PATENT DOCUMENTS

| | | | |
|---|---|---|---|
| 449281 | 7/1949 | Italy | 70/34 |

*Primary Examiner*—Robert L. Wolfe
*Attorney, Agent, or Firm*—Robert E. Ross

[57] ABSTRACT

A lock for a railroad switch or the like, which comprises a housing providing a socket at one end and an elongated shackle having an enlargement on one end and a recess on the other end for cooperating with locking balls in the housing socket to be received in locking engagement therein, in which the operating means for the locking balls in the housing is a rotatable member having an enlarged head disposed in a recess at the end of the housing opposite the socket end, the interior of said recess being cylindrical, the periphery of the enlarged head being sufficiently out of round to enable it to be rotated by a tool having a suitably shaped recess, yet not sufficiently out of round to be readily apparent from visual observation.

2 Claims, 4 Drawing Figures

LOCK

BACKGROUND OF THE INVENTION

In recent years there has been a great increase in vandalism of railroad equipment. One of the more dangerous acts of vandalism is that of breaking the padlock on rail switches to enable the switch to be thrown to an unauthorized position. The padlocks commonly used on switches are often easily broken with a hammer or pry-bar.

SUMMARY OF THE INVENTION

This invention provides a lock especially designed for railroad switches, but, of course, useful in other applications, which is much more difficult to break than the ordinary type of padlock. A special tool is required to open the lock. One of the important features of the lock is that the method of opening is not readily apparent from a visual inspection by an unauthorized person.

A housing is provided with a socket at one end to receive an end of an elongated shackle in locking engagement, said end of the shackle has a recess, and the housing has a pair of locking members movable into the recess of the assembled shackle end by rotation of a shaft which is spring biased to the locking position.

The other end of the housing has a recess, in the bottom of which is disposed an enlarged head connected to the shaft. The interior of the housing recess is cylindrical, whereas the enlarged head is out of round by a small amount, which amount is sufficient to enable the head to be rotated by a tool having a similarly shaped recess but not sufficient to be readily detected by visual inspection.

DESCRIPTION OF THE ILLUSTRATED EMBODIMENT

Figure 1:
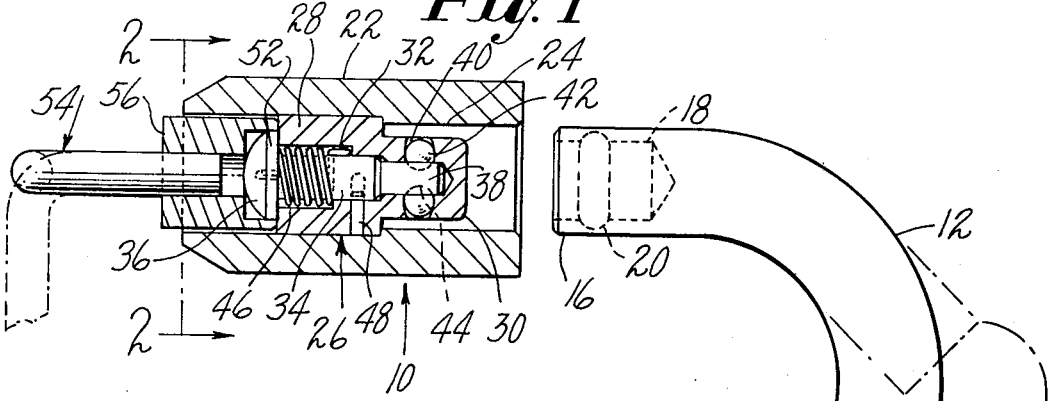
FIG. 1 is a view in side elevation partly in section of a lock embodying the features of the invention, in which the locking end of the shackle is positioned for assembly into the housing socket, and the lock operating shaft in the housing has been rotated, to allow the balls to move to the unlocking position by the operating tool.
Figure 2:
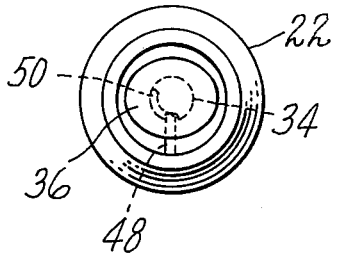
FIG. 2 is a view in section taken on line 2—2 of FIG. 1.

Referring to the drawing, there is illustrated a lock for assembly into suitable aligned apertures in an operating mechanism of a device such as a railroad switch or the like (not shown), said lock comprising a housing 10 and a shackle 12 adapted for locking engagement.

The shackle 12 may have any desired shape, such as being curved in the manner of a padlock shackle, or may be straight, depending on the particular application in which it is to be used. The shackle 12 is generally of uniform diameter throughout its length, except for an enlarged portion 14 on one end thereof. The other end 16 has an opening 18 with an internal peripheral recess

20 spaced inwardly from the opening entrance a predetermined distance.

The housing 10 comprises an outer member 22 having an opening 24 extending therethrough, and a locking mechanism 26 press fitted or otherwise retained in the housing, so that each end of the locking mechanism is spaced inwardly from the adjacent end of the housing.

The locking mechanism comprises an outer stationary portion 28 having a reduced end portion 30 and an internal opening 32, and a rotatable operating member 34 disposed in the opening 32. The operating member 34 has an enlarged head 36 on one end thereof disposed outside the stationary portion 28 and within the housing 10 and a forwardly projecting ball positioning member 38 extending into the reduced end portion 30.

The reduced end portion 30 is provided with a pair of side apertures 40 for carrying locking balls 42 each of which is retained between a restricted portion of the openings at the surface of the end portion 30 and the ball positioning member 38.

The ball positioning member 38 is provided with a pair of shallow recesses 44 disposed 180° apart, and the ball positioning member, the locking balls and the end portion 30 of the stationary member 28 are so dimensioned that when the operating member 34 is rotated to the un-locking position, the balls 42 seat in the recesses 44, and the outer surface of each ball is substantially at the surface of the reduced end portion 30 of the stationary member, so that the end 16 of the shackle can be inserted into the housing, with the reduced end portion 30 entering the opening 16 in the shackle, with the balls 42 being positioned opposite the peripheral recess 20 of the shackle.

Thereafter rotation of the operating member 34 to the locking position will cause the balls 42 to be cammed outwardly on the surface of the ball positioning member so that the outer surface of the balls project into the shackle recess 20, preventing removal of the shackle from the housing.

The operating member 34 is biased in rotation in a clockwise direction as seen from the left end by a spring 46 disposed about the operating member, said spring 46 being connected at one end to the head 36 and at the other end to the stationary member 28.

In the illustrated embodiment the clockwise rotation of the operating member 34 is limited by a pin 48 mounted in the stationary member and projecting into a groove 50 in the operating member which extends throughout 90° of the periphery thereof. The spring 46 and the pin 48 normally maintain the operating member in an orientation such that the recesses 44 in the ball positioning member 38 are 90° away from the unlocking position.

Rotation of the operating member to the unlocking position is accomplished by rotation of the head 36 with a suitable tool, as will now be described.

The head 36 comprises a peripheral portion 52 and a domed center portion 54 giving generally the appearance as seen from the outside of the housing, of the head of a so-called carriage bolt or of the head of a rivet.

In the illustrated embodiment of the invention the plan shape of the head is such that the peripheral portion 52 is not a true circle, but has the shape of an ellipse with only a small difference between the long and short diameters. The variation from a true circle is not so great that it is readily noticeable from a visual inspection from outside the housing. However, if it is noticed, it appears to be merely an unintended out of round shape resulting from a manufacturing defect.

However, the difference from a true circle is sufficient to allow the head to be rotated by a tool 54 having a head-engaging portion 56 with a recess 58 of cross-sectional shape similar to the plan shape of the peripheral portion of the head. The portion 56 has a cylindrical shape dimensioned to fit closely inside the housing 22, so that the tool is properly aligned on the head and is prevented from sideways or tilting movement during rotation.

The positioning of the head recessed in the housing also prevents access to the head by pliers, or other tools with serrated jaws.

Although in the illustrated embodiment the head is formed with an out of round periphery, other shapes could be used, so long as the head can be rotated against the force of the spring by a suitable tool, and preferably with an appearance that does not suggest that it is the head of a fastener susceptible to operation by rotation.

Figure 3:
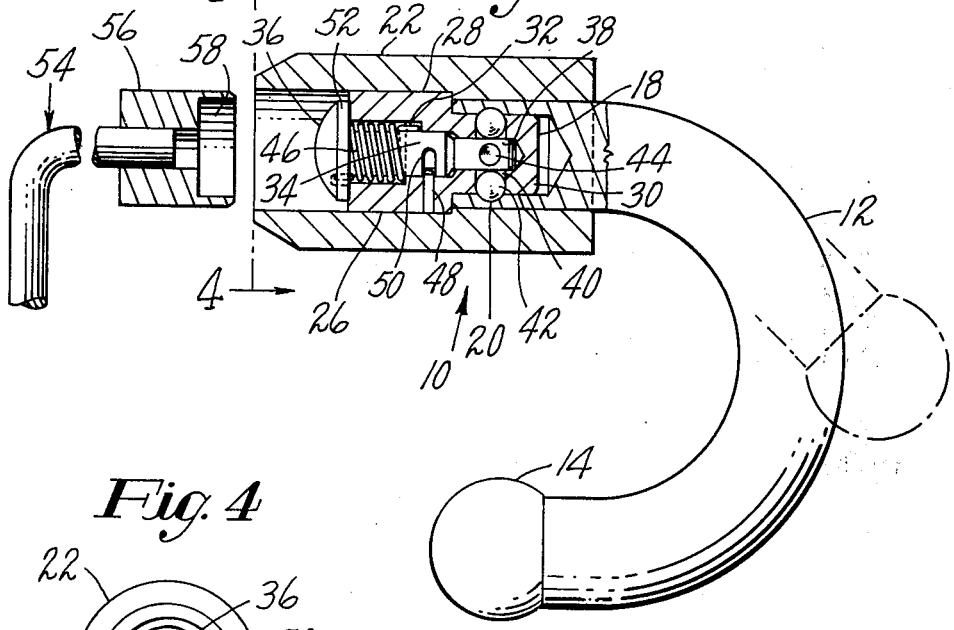
FIG. 3 is a view similar to FIG. 1 in which the shackle end has been assembled into the housing socket and the lock operating shaft has rotated to the locking position.
Figure 4:
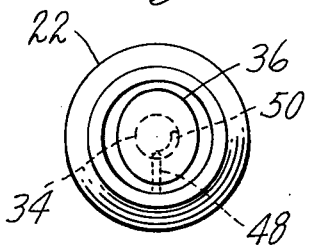
FIG. 4 is a view of the housing of FIG. 3 as seen from the left end, as taken on line 4—4 of FIG. 3.

The spring 46 is sufficiently strong and under sufficient tension, when the operating member 34 is in the locking position (see FIG. 3), that considerable force is required to rotate the operating member 90° to the unlocking position. Unlocking is therefore impossible, in any reasonable time, by the use of any tool ordinarily carried by vandals.

It is possible that the operating member, if made of carbon steel, could be rotated by a strong magnet of the proper shape. To avoid this possibility the operating member could be formed of a non-magnetic material such as austenitic stainless steel.

Since certain changes apparent to one skilled in the art could be made in the illustrated embodiment of the invention, it is intended that all matter contained herein be interpreted in an illustrative and not a limiting sense.

I claim:

1. A lock and shackle assembly, comprising a shackle having a peripheral recess near one end, and a lock assembly comprising a housing and a locking mechanism disposed inside the housing, said mechanism including a shackle engaging member having radially movable locking members for entering the peripheral recess of the shackle end when in the locking condition, a rotatable shaft having an end portion positioned and dimensioned to force said locking members into the locking condition when in one orientation and to allow said locking members to move to the unlocking condition when in another orientation, spring means biasing said shaft in rotation toward the locking orientation, said shaft having an operating head at the end opposite the locking members, said head having a plan shape that appears to be substantially circular and is sufficiently out-of-round to enable it to be rotated against the force of the spring to the unlocking orientation by a tool having a recess corresponding in shape to that of the operating head.

2. A lock and shackle assembly as set out in claim 1 in which said one end of the shackle has a cavity, said peripheral recess being disposed in the cavity wall, and the shackle engaging member is recessed in one end of the housing and protrudes toward the adjacent housing end to enter the shackle cavity when the shackle end is inserted into said one end of the housing.

* * * * *